US005839839A

United States Patent [19]

Brot et al.

[11] Patent Number: 5,839,839

[45] Date of Patent: Nov. 24, 1998

[54] INK-FILM REFILL FOR HEAT-TRANSFER PRINTER

[75] Inventors: Michel Brot, Argenteuil; Alex Kuhn, Auvers Sur Oise, both of France

[73] Assignee: SAGEM SA, Paris, France

[21] Appl. No.: 792,734

[22] Filed: Jan. 31, 1997

[30] Foreign Application Priority Data

Feb. 2, 1996 [FR] France ..... 96 01278

[51] Int. Cl.[6] ..... B65D 85/66

[52] U.S. Cl. ..... 400/242; 400/207; 206/391; 206/410

[58] Field of Search ..... 400/246, 208, 400/207, 242; 206/391, 410, 398, 400, 401, 393

[56] References Cited

U.S. PATENT DOCUMENTS

| | | | |
|---|---|---|---|
| 2,930,469 | 3/1960 | Roggenstein | 400/208 |
| 2,999,578 | 9/1961 | Holden | 400/207 |
| 3,460,671 | 8/1969 | Harm | 206/391 |
| 5,415,486 | 5/1995 | Wouters et al. | 400/692 |
| 5,536,094 | 7/1996 | Kondo | 400/247 |

FOREIGN PATENT DOCUMENTS

| | | |
|---|---|---|
| 1 588 735 | 3/1970 | France . |
| 40 10 314 | 10/1990 | Germany . |
| 1-308665 | 12/1989 | Japan . |
| 61-215078 | 9/1996 | Japan . |

*Primary Examiner*—Edgar S. Burr
*Assistant Examiner*—Dave A. Ghatt
*Attorney, Agent, or Firm*—McDermott, Will & Emery

[57] ABSTRACT

An ink-film refill for heat-transfer printers comprises a film dispenser-roll, the free end of the film being affixed to a receiving mandril. The roll and the mandril rest against each other and have their axes substantially mutually parallel, adhesive means keeping them in position, the adhesive means comprising at least one non-adhesive end forming a gripping zone to break the bond between them and to render roll and mandril mutually free.

3 Claims, 1 Drawing Sheet

INK-FILM REFILL FOR HEAT-TRANSFER PRINTER

Figure 1:
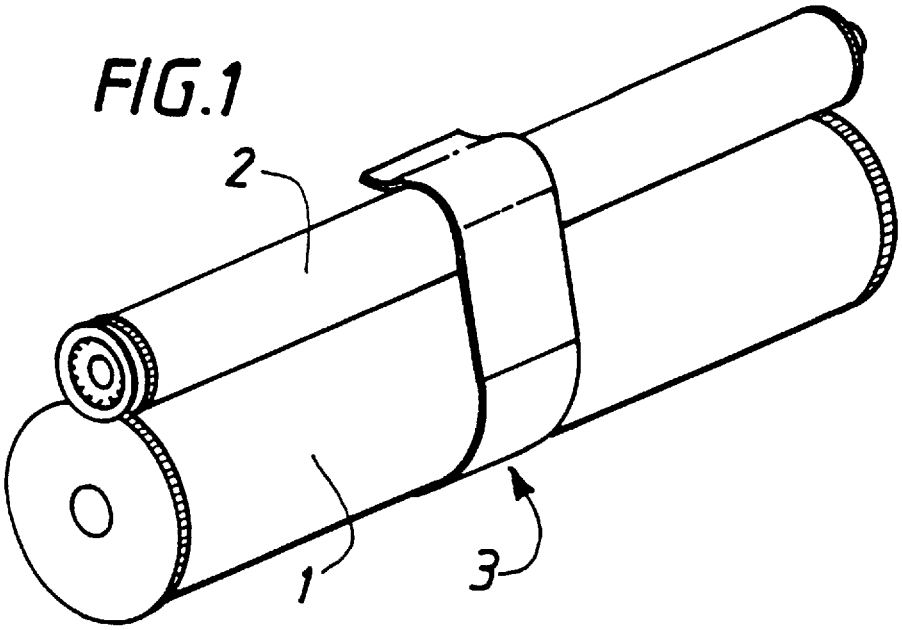

The present invention concerns an ink-film refill for heat-transfer printers and comprising a film dispenser-roll of which the free end is affixed to a receiving mandril, roll and mandril resting against each other while their axes are substantially parallel, further comprising adhesive means maintaining them in said position, said means including at least one non-adhesive end forming a gripping zone for the purpose of freeing them from adhesion and releasing the roll and mandril from one another.

It is known that heat-transfer printers use normal paper. Ink is transfer-deposited from an ink-film by means of a heat head on this paper. In general this ink film is in the form of a roll inside a plastic cassette next to a receiving mandril on which the film is being wound as it is being used.

Each time the film is exhausted this cassette is changed together with the roll. Accordingly such a change is comparatively costly. It is also polluting because a plastic cassette is discarded with each change of film roll. Lastly the cassette takes up a relatively large space in the printer.

It has already been suggested to mount the film roll in a case from which it shall be withdrawn before being installed in the printer.

Besides such a solution entailing a disposable container, it also raises some difficulties in installing the film: there is some risk of letting the roll or the mandril drop and thereby unwinding the film before installation in the printer.

The Japanese patent document 61/215,078 discloses a refill of the above defined species, which however evinces the above drawbacks.

The object of the present invention is palliation of these drawbacks.

Accordingly the object of the invention is an ink-film refill comprising a film-dispensing roll of which the free end is affixed to a receiving mandril, roll and mandril resting against each other and having substantially mutually parallel axes, adhesive means keeping them in this position, said means including at least one non-adhesive end forming a gripping zone to detach the roll from the mandril so that their adhesive bond be destroyed and roll and mandril be free from each other, characterized in that said adhesive means comprise a ribbon enclosing the assembly consisting of the dispenser roll and the receiving mandril and of which the ends are mutually overlapping, and a tab endowed with adhesive at one of its ends and at its middle zone in order to adhere to the overlapping ribbon end and to the ribbon portion issuing from underneath said overlapping end, the other end of said tab being free of adhesive and constituting said gripping zone.

Thanks to the invention, the refill can be installed in especially easy manner. After the dispensing roll has been installed in the printer, and without having detached the adhesive means, it is enough to detach the tab from the ribbon and to pull and easily remove the ribbon using the tab before installing the receiving mandril. The danger of mishandling the film and thereby unreeling it is avoided thereby.

The refill of the invention may be easily packaged into a flexible wrap such as an economical, non-polluting paper or plastic bag, whence no box or cassette need being disposed of at each change of ink-film roll. Nor is any useless space taken up in the printer.

In a preferred embodiment, said ribbon may comprise an end partly enclosing the dispenser roll, it may wind about the receiving mandril, wind again about the dispenser roll, and its other end may be in the vicinity of the receiving mandril.

In particular said ribbon may enclose, from its overlapping end to its overlapped end in the direction opposite that of the film winding on said reel, the assembly of roll and mandril.

In a particular embodiment, said tab end fitted with adhesive is applied to the overlapping ribbon end and the middle zone of the tab is applied to said emerging ribbon portion.

Another object of the invention is a method for refilling with ink film a heat-transfer printer designed to accept a refill such as was described above, characterized in that said refill is inserted into the printer by installing one of the components, namely roll or mandril, by removing said adhesive means and then putting in place the other of said components.

In particular the film dispenser roll may be installed first.

A particular illustrative embodiment of the invention is described below in non-restrictive manner and in relation to the attached schematic drawings.

FIG. 1 is a perspective of an ink-film refill of the invention, and

Figure 2:
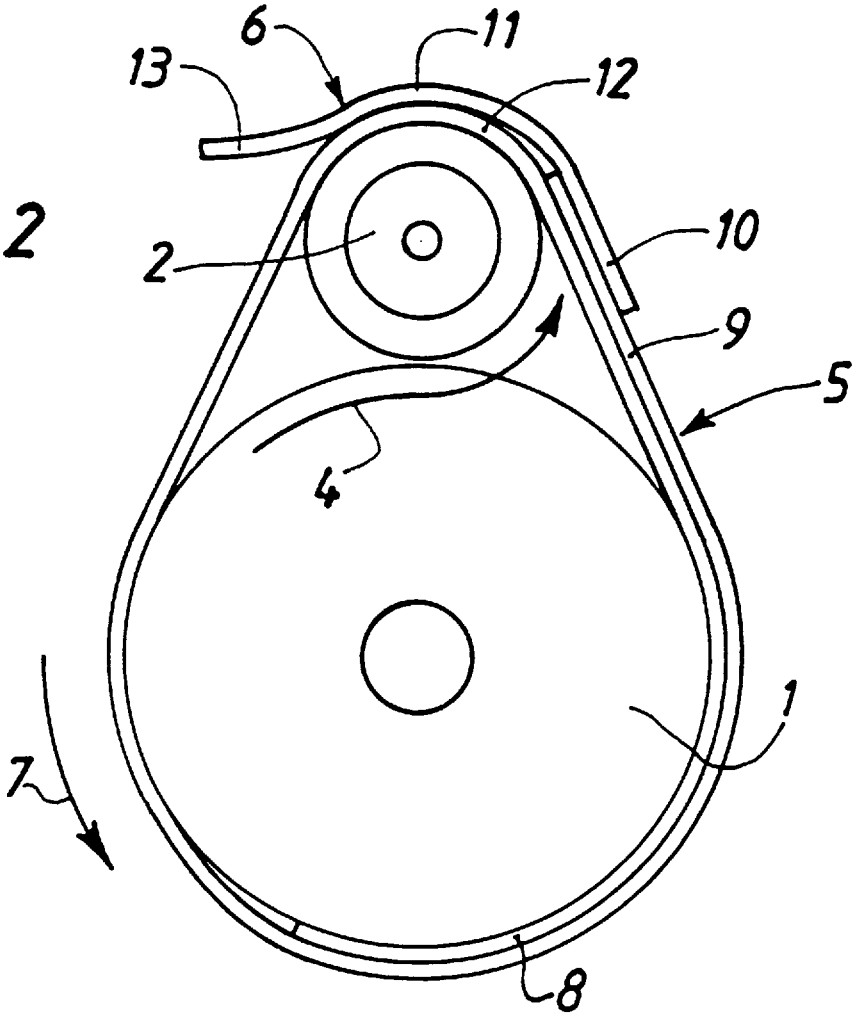

FIG. 2 is a front view wherein the thickness of the adhesive means is considerably enlarged for clarity, Essentially the refill of the invention comprises a film dispenser-roll 1, a receiving mandril 2 and adhesive means 3 allowing to mutually affix the roll 1 and the mandril 2 so that they rest against each other and their axes be substantially parallel. When in use, the film passes from the dispenser roll 1 to the receiving mandril 2 as shown by the arrow 4 of FIG. 2.

The adhesive means comprise a non-adhesive ribbon 5 wound around the dispenser roll and the receiving mandril, and a tab 6 keeping the ribbon 5 in place.

As shown in FIG. 2, the ribbon 5 is wound from the inside to the outside around the assembly in the direction of the arrow 7 and comprises an end 8 partly enclosing the dispenser roll 1 and winds around the receiving mandril 2 and then winds again around the dispenser roll, the other end 9 of this ribbon 5 being near the receiving mandril. Accordingly the ribbon 5 winds around the assembly of roller and mandril from its overlapped end 8 to its overlapping end 9 in the direction which is opposite that in which the film is wound on said roll.

The tab 6 is fitted with adhesive at one (10) of its ends and at its middle zone 11 in order to respectively adhere to the ribbon overlapping portion 9 and to the ribbon portion 12 emerging from underneath this overlapping end. The other end 13 of the tab 6 is free of adhesive and thereby constitutes a gripping zone to seize and to remove the adhesive bond of the adhesive means 3.

The above installation of the refill in an appropriately designed printer is implemented as follows:

The adhesive means 3 having been preserved following removal of the roll and of the mandril from their packaging, the dispenser roll 1 is installed free of danger of accidental unreeling of the ink film. Thereupon the adhesive bond of the tab 6 to the ribbon portion 12 is broken, the tab end 10 however remaining bonded to the ribbon end 9. This ribbon therefore may be removed from the printer by pulling on the tab 6. Because the ribbon 5 is non-adhesive, said removal is easily carried out. Thereupon the mandril 2 is installed.

We claim:

1. An ink-film refill for a heat-transfer printer, comprising:

a film dispenser-roll;

a receiving mandril for affixing a free end of the ink-film, roll and mandril resting against each other and having their axes substantially mutually parallel; and adhesive means for keeping the roll and the mandril resting against each other with their axes substantially mutually parallel, the adhesive means including at least one non-adhesive end forming a gripping zone in order to break the adhesive bond between roll and mandril and render them mutually free;

wherein said adhesive means comprise:

a ribbon enclosing an assembly comprising the dispenser roll and the receiving mandril, the ribbon having an overlapping end and an overlapped end mutually overlapping to form an overlapping portion of the ribbon, and a tab with an adhesive deposited at a first end of the tab and at a middle zone of the tab for adhering to the overlapping portion of the ribbon and to a non-overlapping portion of the ribbon, the tab having a second end free of adhesive and comprising said gripping zone;

wherein the first end of the tab is in contact with the overlapping end of the ribbon and the middle zone of the tab is in contact with an emerging portion of the non-overlapping portion of the ribbon.

2. The refill as claimed in claim 1, wherein said ribbon comprises one end partly winding around the dispenser roll and winding around the receiving mandril, then again winding around the dispenser roll, and another end located near the receiving mandril.

3. The refill as claimed in claim 1, wherein said ribbon encloses the assembly of roll and mandril from its overlapped end to its overlapping end in the direction opposite to that in which is wound the film on said roll.

* * * * *